US005319820A

United States Patent [19]

Forst

[11] Patent Number: 5,319,820

[45] Date of Patent: Jun. 14, 1994

[54] APPARATUS FOR CLEANING BLACKBOARDS

[76] Inventor: Solomon Forst, 146 Van Nostrand Ave., Englewood, N.J. 07631

[21] Appl. No.: 10,261

[22] Filed: Jan. 28, 1993

[51] Int. Cl.[5] ..... A47L 1/00

[52] U.S. Cl. ..... 15/98; 15/52.2; 15/103; 15/220.1; 15/246

[58] Field of Search ..... 15/21.1, 52.2, 98, 103, 15/220.1, 220.2, 246, 250.001, 250.24, 250.29; 134/172

[56] References Cited

U.S. PATENT DOCUMENTS

| | | | |
|---|---|---|---|
| 998,579 | 1/1911 | Herz | 134/172 |
| 1,416,280 | 5/1922 | Gazdzicki . | |
| 2,167,296 | 7/1939 | Farmer . | |
| 2,435,862 | 2/1948 | Wilson . | |
| 3,163,943 | 1/1965 | Bell . | |
| 3,218,663 | 11/1965 | Battista | 15/98 |
| 3,731,335 | 5/1973 | Chrisp . | |
| 3,858,265 | 1/1975 | Schlick . | |
| 4,257,138 | 3/1981 | Clements | 15/103 |
| 4,946,513 | 8/1990 | Del Prato | 134/172 |
| 5,167,720 | 12/1982 | Diamond | 134/172 |
| 5,179,758 | 1/1993 | Smith | 15/250.24 |

FOREIGN PATENT DOCUMENTS

| | | | |
|---|---|---|---|
| 2748142 | 5/1979 | Fed. Rep. of Germany | 15/103 |
| 627200 | 9/1927 | France | 15/246 |
| 2599614 | 12/1987 | France | 15/21.1 |

*Primary Examiner*—Philip R. Coe
*Assistant Examiner*—Terrence R. Till
*Attorney, Agent, or Firm*—Cooper & Dunham

[57] ABSTRACT

An apparatus for cleaning a blackboard mounted on a wall including a cleaning head pivotally mounted on a vertical rod so as to be slidable vertically along the rod and rotatable about a vertical axis, into and out of cleaning engagement with the blackboard. At its upper and lower extremities, the rod is secured to a pair of carriages connected together and respectively horizontally movable, by rolling, along top and bottom channel tracks fixedly mounted on the wall respectively above and below the board. The cleaning head includes a sponge holder connected to the vertical rod by brackets and a sponge having a backing removably secured to the holder.

11 Claims, 3 Drawing Sheets

APPARATUS FOR CLEANING BLACKBOARDS

BACKGROUND OF THE INVENTION

The present invention relates generally to blackboard or wall erasers, and more particularly to an apparatus providing guided manual cleaning action for removing chalk or other marks from selected portions of a blackboard or like erasable and reusable writing surface on a wall.

U.S. Pat. Nos. 2,167,296 (Farmer); 3,858,265 (Schlick) and 3,731,335 (Chrisp) show previously proposed blackboard cleaning devices. Each of these proposed devices provides a motorized mechanism, and has an eraser or sponge and an associated mount extending vertically to cover the entire height of the blackboard, the erasers or sponges being continuously engaged with the surface of the board. Thus, each device is designed to erase or clean an entire board in one pass or sweep of the eraser over the entire surface of the board, controlled entirely by a motorized drive. None of the proposed devices can erase a selected portion of the board while leaving other portions unerased, such as, for example, the bottom half or a single quadrant.

U.S. Pat. No. 3,163,943 (Bell) shows a manually operated mechanical blackboard eraser having means for selectively disengaging the eraser from the board to leave a portion of the board unerased. However, the eraser and its associated mount again extend over the entire height of the board; hence a full-height vertical section of the board must be left uncleaned to save what is written on any part of that section.

Since each of the prior devices mentioned above has an erasing or cleaning member of more or less complex structure extending for the full height of the blackboard, it is necessary to custom-make (or at least custom-fit) the erasing/cleaning member for a particular blackboard height, and the custom-made erasing/cleaning member cannot be used with a blackboard of a different height. Both the inherent cost of the large erasing/cleaning member, and the inability to produce such members in a single size to fit all blackboards, add to the expense of manufacture of the prior devices.

In addition, since none of the erasers and sponges of the abovedescribed prior devices is readily detachable from its associated mount, cleaning and replacement of the eraser or sponge is difficult.

SUMMARY OF THE INVENTION

An object of the present invention is to provide apparatus for cleaning a blackboard or the like which enables a user to clean or erase selected portions of a blackboard, of less than the full vertical extent of the board, by controlled, guided manual motion.

Another object is to provide blackboard or like cleaning apparatus which can be selectively engaged with the surface of the blackboard.

A further object is to provide blackboard or like cleaning apparatus having a wiping or cleaning element which is readily detachable from its associated mount for fast and convenient cleaning and replacement.

Yet another object is to provide blackboard or like cleaning apparatus having a cleaning head of fixed vertical dimension, and arranged to enable such head to clean boards having a wide range of vertical dimensions, such that the apparatus can be mass-produced in a single size for use with many different sizes of boards.

To these and other ends, the present invention broadly contemplates the provision of apparatus for cleaning a wall-mounted blackboard or the like having a smooth vertical writable surface and mounted on a wall, such apparatus comprising a frame having a vertical extent substantially equal to the surface; means for supporting the frame on the wall for manual movement of the frame horizontally back and forth across the surface; a cleaning head including a holder and a wiping element, removably carried by the holder, for cleaning the surface, the cleaning head having a vertical extent substantially shorter than the vertical dimension of the surface; means for mounting the holder on the frame for sliding manual vertical movement relative to the surface, and for pivotal manual movement about a vertical axis between a first position in which the wiping element engages the surface and a second position in which the wiping element is out of engagement with the surface, the wiping element being detachable from the holder when the holder is in the second position.

In currently preferred embodiments of the invention, a cleaning head covering a fraction of the height of a blackboard is pivotally mounted by means of brackets on a vertical rod so as to be manually slidable vertically along the rod and rotatable about a vertical axis, into and out of cleaning engagement with the blackboard. At its upper and lower extremities, the rod is secured to a pair of carriages respectively horizontally movable along top and bottom channel tracks fixedly mounted on the wall respectively above and below the board. Each carriage is provided with means for rolling along its associated track, the two carriages being connected by the aforementioned vertical rod and by a second rod to form a rigid, stable frame structure. The cleaning head comprises a sponge holder connected to the brackets and a wiping element such as a sponge having a backing removably secured to the support member.

In this apparatus, the vertical movability of the cleaning head eliminates the need to provide a cleaning member having a vertical height equal to that of the blackboard. This affords benefits of structural simplicity, low cost and ready adaptability to blackboards of different heights. The pivotal mounting of the cleaning head simplifies removal and replacement of the cleaning member (e.g., eraser or sponge) in a rapid and effective manner, and also readily enables the user to skip over any portion of a board that is not to be erased, including (owing to the limited height of the cleaning head) a portion shorter in vertical extent than the board.

Further features and advantages of the invention will be apparent from the detailed description hereinbelow set forth, together with the accompanying drawings.

DETAILED DESCRIPTION

Figure 1:
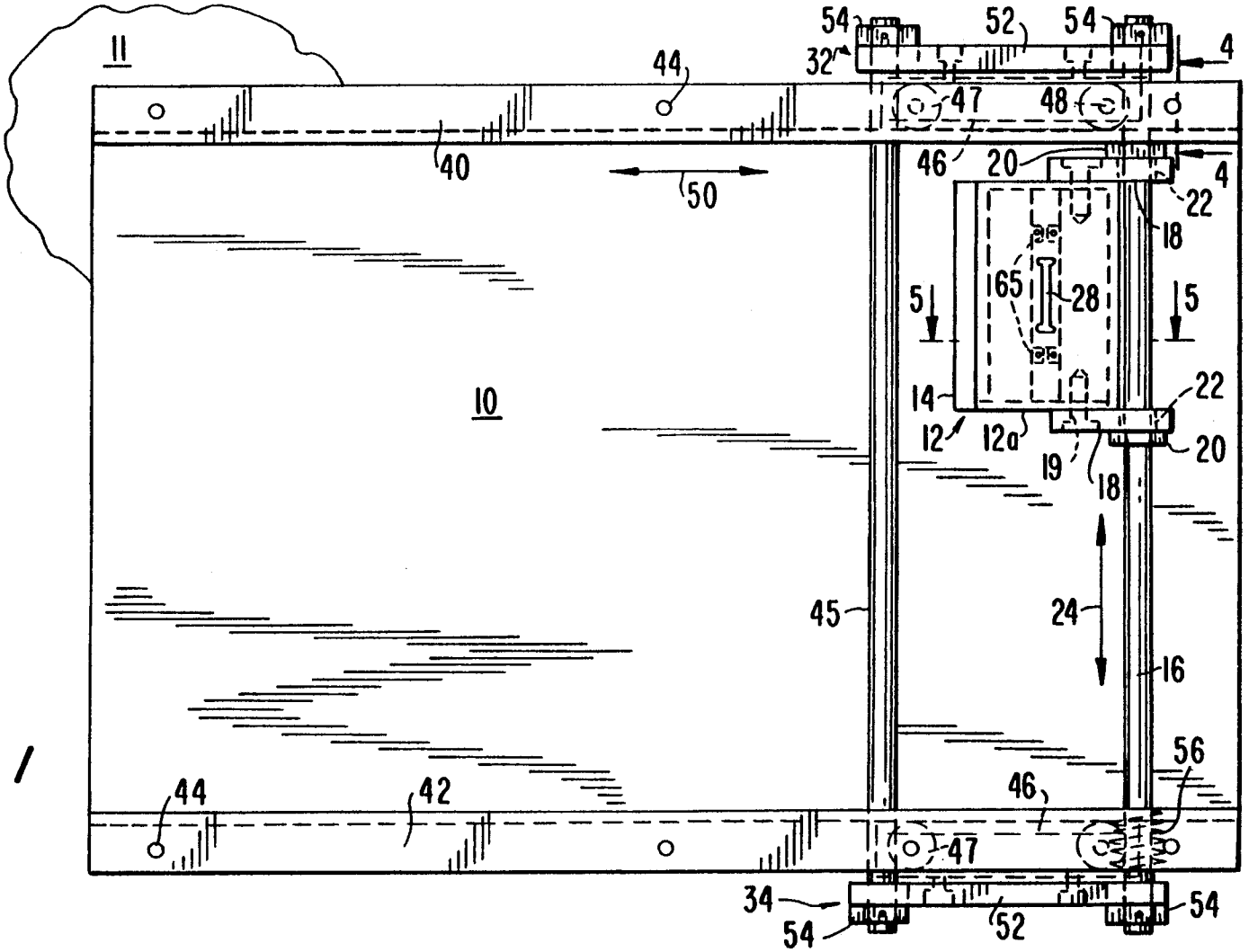
FIG. 1 is a front elevational view of blackboard cleaning apparatus embodying the present invention in a particular form.
Figure 3:
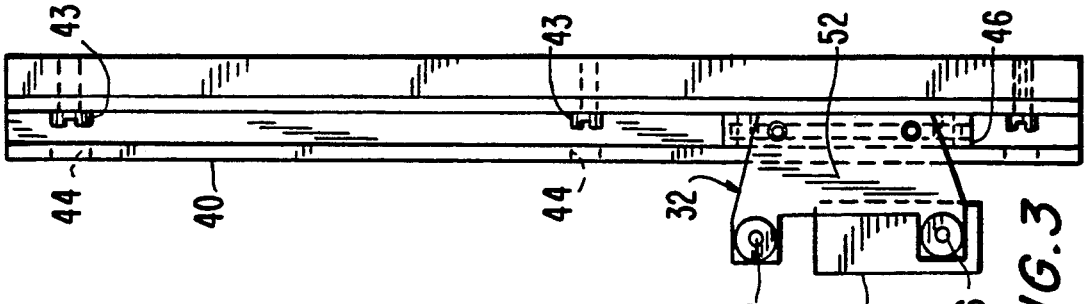
FIG. 3 is a top plan view of the apparatus of FIG. 1.
Figure 5:
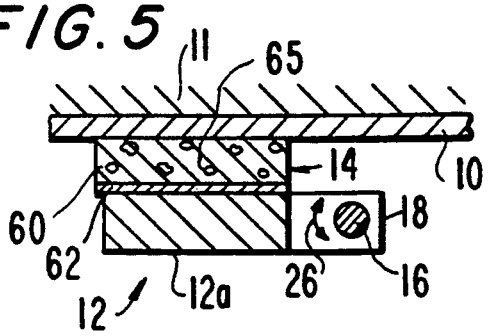
FIG. 5 is a fragmentary schematic cross-sectional view of the sponge and associated elements in blackboard-cleaning position, taken as along the line 5—5 of FIG. 1.
Figure 6:
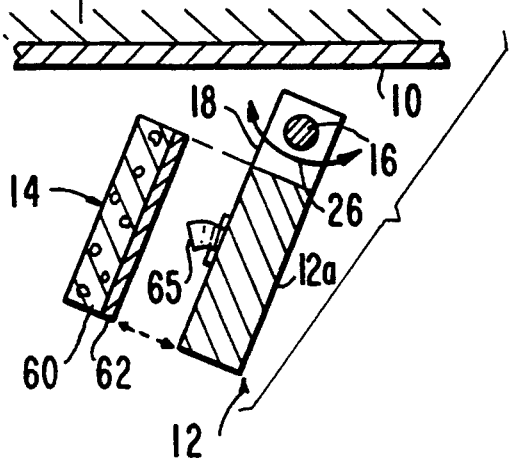
FIG. 6 is a view similar to FIG. 5, but exploded, illustrating the sponge and associated elements in position for removal and/or replacement of the sponge.

The embodiment of the invention illustrated in the drawings is shown in connection with a vertical planar surface 10, such as a blackboard, mounted on a wall 11. In this embodiment, a cleaning head 12 constituted of a rigid rectangular sponge holder 12*a* bearing a wiping element such as a sponge 14, is pivotally mounted on a first vertical rod or shaft 16 by means of two brackets 18 respectively disposed above and below the holder 12*a*. Each bracket 18 is fixedly secured to the holder 12*a* by means of a screw 19 or like fastening element adjacent one end of the bracket, while a bushing 20 is mounted adjacent the other end of each bracket. The rod 16 extends through the bushings 20, and through associated bores 22 formed in the brackets, in such manner that the brackets are vertically slidable along the rod in the direction of arrow 24 (FIG. 1) and are also pivotable or rotatable (in horizontal planes of rotation) about the vertical rod axis as indicated by arrow 26 (FIGS. 5 and 6).

By virtue of this arrangement of the brackets 18 on rod 16, the cleaning head 12 itself is vertically slidable along rod 16 in the direction of arrow 24, and is also rotatable about the vertical rod axis as indicated by arrow 26 into and out of wiping engagement with the board 10 so as to enable cleaning of only selected portions of the board as well as to facilitate removal of the sponge 14 for cleaning or replacement. A handle 28 is mounted on the outwardly facing side of the sponge holder 12*a* for convenience of the user in moving the cleaning head vertically on rod 16, horizontally across the board 10 (as described below), and rotationally.

Figure 4:
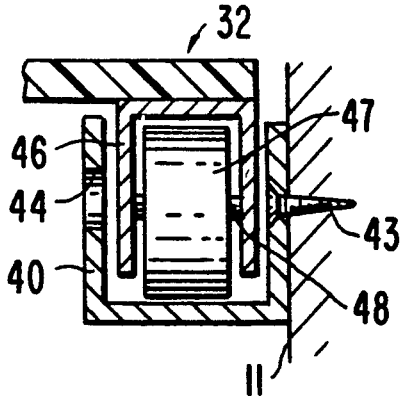
FIG. 4 is a schematic fragmentary sectional view taken along the line 4—4 of FIG. 1.

At its upper and lower extremities, rod 16 is secured to a pair of carriages 32 and 34 respectively associated with (and horizontally movable, by rolling, along) a top channel rail or track 40 and a bottom channel rail or track 42 fixedly mounted to the board 10 respectively along its upper and lower edges by screws 43 (accessible through holes 44 in the forward legs of the channel tracks), and each extending substantially across the horizontal length of the board 10. As shown in FIG. 4, channel track 40 is U-shaped in cross-section, and opens upwardly, away from the board 10. Channel track 42 similarly is U-shaped in cross-section and opens downwardly, away from the board 10.

The two carriages 32 and 34 are connected both by rod 16 and by a second vertical rod 45 to constitute a rigid, stable frame structure that is movable as a unit horizontally across the board with maintained vertical orientation of the rods 16 and 45, as the carriages roll along their respective tracks. Each of the carriages 32 and 34 includes a channel member 46, extending parallel to and received within the channel track 40 or 42 with which it is associated, and opening toward the board 10. A pair of rolling elements are mounted within the channel member 46 of each carriage in rolling engagement with the web of the associated track 40 or 42 for enabling the carriage to move smoothly and easily horizontally across the board 10 in the direction of arrow 50, shown in FIG. 1. As shown in FIGS. 1–4, the rolling elements may be wheels 47 made of any durable material, preferably plastic, rotatably carried by shafts 48 supported by the channel members 46; alternatively, the rolling elements may be ball bearings (not shown), e.g. the ball bearings commercially available from Schatz Manufacturing Company, Poughkeepsie, N.Y. under the model designation BR 9902, mounted in the channel members 46 in the above-described rolling engagement with the channel track webs. Each of the carriages also includes a guide member 52, secured to the channel member 46 and projecting outwardly therefrom. A pair of bushings 54 are carried by each of these guide members for respectively receiving the extremities of the two rods 16 and 45.

A helical spring 56 is disposed in surrounding relation to the lower portion of the rod 16, resting on the guide member 52 of the lower carriage 34. This spring serves to cushion the cleaning head 12 against impact with the carriage 34 when the cleaning head is moved or dropped downwardly to the lower limit of its vertical travel on the rod 16.

Figure 7:
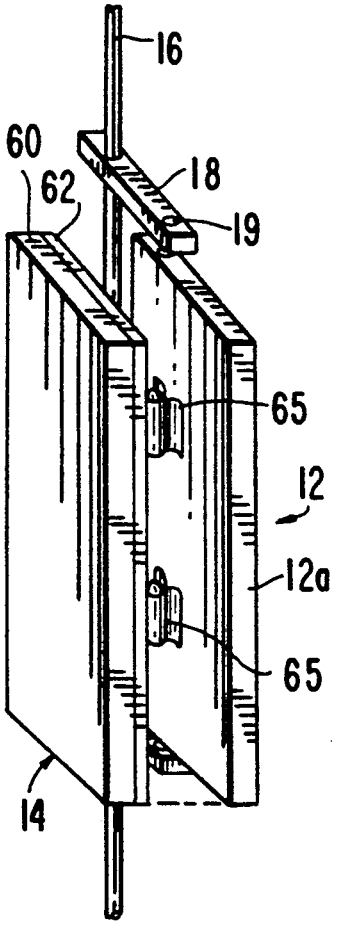
FIG. 7 is an exploded schematic perspective view of the cleaning head of the apparatus of FIG. 1.

The sponge 14 includes a porous, compressible sponge body 60 and a rigid plastic backing member 62 to which the body 60 is adhered. The backing member 62 has holes (not shown), into which are fastened spring clips 65 attached to sponge holder 12*a*, removably securing the sponge to the sponge holder, as shown in FIGS. 5, 6 and 7. This arrangement provides for fast and easy removal of sponge 14 for cleaning or replacement, without the need to disassemble the apparatus or for auxiliary attachments.

Because sponge 14 is easily detachable from the holder 12*a*, sponges or other cleaning elements of any desired material can readily be made for use in the apparatus. For example, a felt eraser can be used several times to erase chalk marking on the board. A damp sponge can be substituted when it is desired to fully clean the board. A dirty or dried-out sponge can be rapidly removed for cleaning, remoistening and return to the cleaning head, or for replacement with a fresh sponge. The apparatus can be adapted for cleaning any vertical surface simply by using a sponge of a suitable material.

The size of the cleaning head 12 including holder 12*a* and sponge 14 can be selected according to the preference of the user. More generally, in accordance with the invention the vertical height of the cleaning head is substantially smaller than the vertical extent of the blackboard 10, and thus substantially smaller than the vertical spacing between the tracks 40 and 42. For example, the height of the head 12 may be less than one-half the height of the blackboard, or even smaller, e.g., one-fourth or less of the board height. Owing to the small vertical extent of the cleaning head, in relation to the overall blackboard height, as well as to the vertically movable and horizontally pivotable mounting of the cleaning head, a user can erase or clean selected horizontal portions of the board 10 without erasing the entire vertical area. The brackets 18 can mount a cleaning head of any vertical extent smaller than the distance between the guides 52 of the upper and lower carriages.

Moreover, with a cleaning head of relatively small vertical size in relation to a conventional range of blackboard heights, the same cleaning apparatus of the invention can be installed on blackboards of widely varying vertical as well as horizontal dimensions simply by cutting the rods 16 and 45 and the tracks 40 and 42 to appropriate lengths. There is no need to provide cleaning heads of different size for blackboards of different heights.

As will be appreciated, the apparatus of the invention in its illustrated embodiment is installed simply by cutting the rods and tracks to the proper lengths, mounting the tracks on the wall along the top and bottom of a blackboard, assembling the frame structure comprising the carriages and rods together with the cleaning head, and fitting the two carriages into the respective tracks.

The use and operation of the apparatus may now be readily explained. At rest, the cleaning head 12 sits at the lower end of rod 16, on spring 56, and the frame constituted of the rods and carriages is disposed at one end of the tracks 40 and 42, i.e., at one side of the blackboard, so that the blackboard itself is accessible for writing and viewing. Preparatory to a cleaning operation, the user grasps the handle 28, raises the cleaning head to a convenient height on rod 16, pivots or rotates the head 12 outwardly away from the blackboard as shown in FIG. 6, and mounts a cleaned and moistened sponge 14 on the clips 65.

Figure 2:
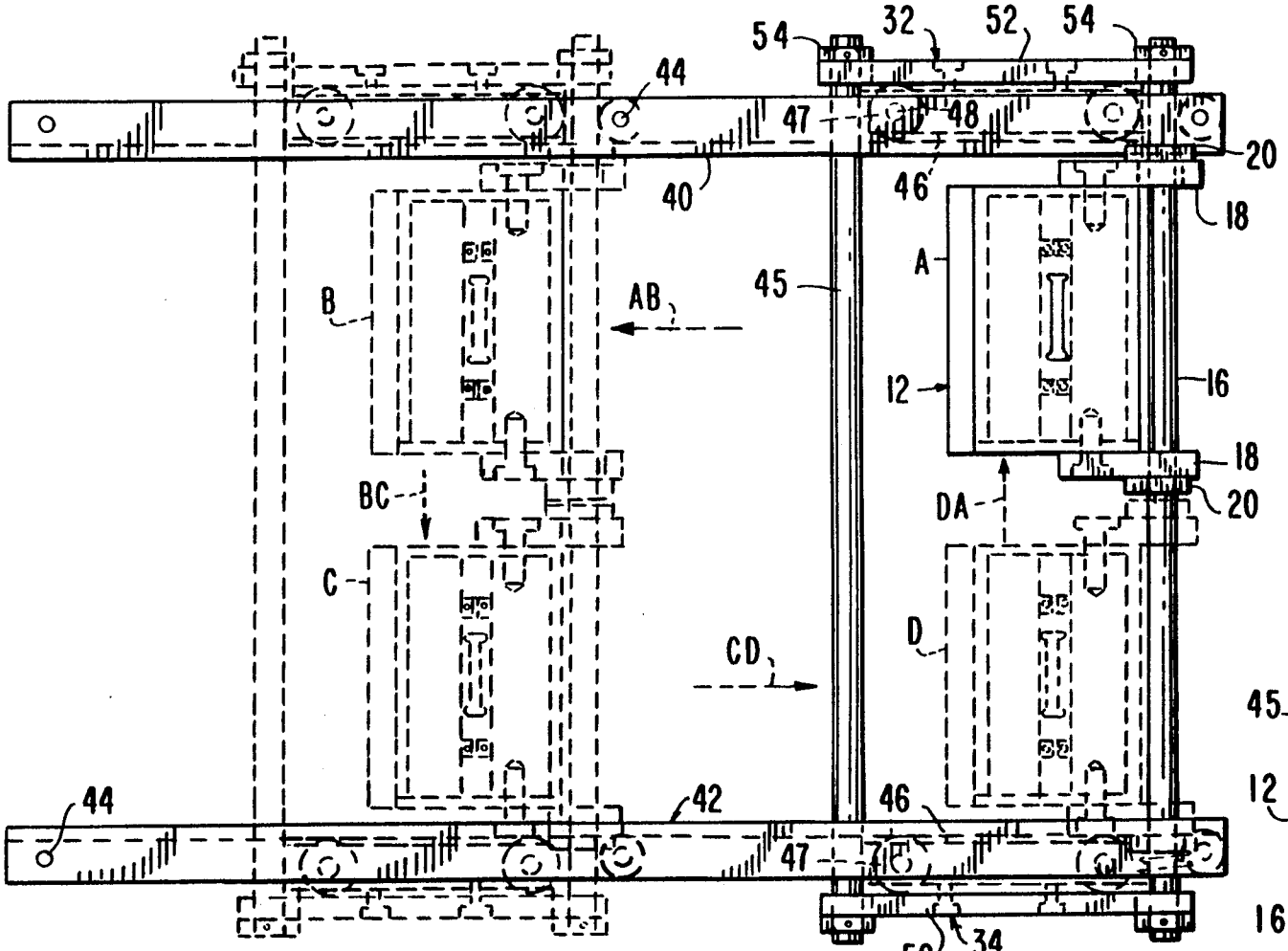
FIG. 2 is a view similar to FIG. 1 but illustrating, in phantom outline, several different positions of the apparatus relative to a blackboard being cleaned.

FIG. 2 illustrates an exemplary cleaning operation with the described apparatus. After the sponge is mounted on the cleaning head, the user moves the head (in the direction of arrow DA, FIG. 2) to an upper corner of the board (position A, at the upper right in FIG. 2), and pivots the head so that the sponge fully engages the board surface as represented in FIG. 5. Still grasping the handle, the user moves the cleaning head (in maintained engagement of the sponge with the board surface) in a first horizontal pass across the entire length of the board (arrow AB, FIG. 2) to the opposite upper corner of the board (position B, at the upper left in FIG. 2). This wipes and washes a horizontal strip of the board surface, just below upper track 42, equal in height to the sponge 14. The roller mounting of the carriages 32 and 34 ensures smooth horizontal motion as the cleaning head and frame are moved by the user's hand grasping the handle 28.

The user then moves the head 12 vertically downward (arrow BC, FIG. 2) to a lower position C directly below position B and, while continuing to maintain the sponge pressed against the board surface, executes a reverse horizontal pass (arrow CD, FIG. 2) at a lower elevation than the pass represented by arrow AB, until position D is reached, directly below position A. This procedure is repeated, preferably with some overlap between successively higher horizontal passes, until the entire board has been cleaned. Each time the cleaning head, in wiping engagement with the blackboard surface, is moved manually across the full (or a selected part of the) horizontal width of that surface, it is guided in such horizontal movement by the frame constituted of the rods 16 and 45 and carriages 32 and 34 rolling along the horizontal tracks 40 and 42. At the completion of the cleaning operation, the cleaning head is returned to the rest position, and (if desired) the sponge may be removed by pivoting the head away from the board.

If it is desired to leave a portion of the board unerased, the cleaning head is simply pivoted out of the way (FIG. 6) each time it passes over that portion of the board.

It is to be understood that the invention is not limited to the features and embodiments hereinabove specifically set forth, but may be carried out in other ways without departure from its spirit.

I claim:

1. Apparatus for cleaning a vertical planar surface mounted on a wall, comprising:

top and bottom channel tracks fixedly mounted on the wall respectively above and below the surface;

top and bottom carriages respectively horizontally movable along said top and bottom channel tracks;

means for connecting together the top and bottom carriages; and a cleaning head pivotally and slidably mounted on the connecting means for selective wiping engagement with the surface.

2. A cleaning apparatus according to claim 1, wherein the length of the cleaning head is less than the height of the surface.

3. A cleaning apparatus according to claim 1, wherein the cleaning head comprises a holder mounted on the connecting means and a wiping element removably secured to the cleaning head.

4. A cleaning apparatus according to claim 1, wherein each carriage includes means for rollingly engaging the channel track along which the carriage moves.

5. A cleaning apparatus according to claim 1, wherein the cleaning head comprises a holder mounted on the connecting means and a wiping element fitted onto the cleaning head and removable therefrom when the cleaning head is pivoted out of engagement with the surface.

6. A cleaning apparatus according to claim 1, wherein the connecting means comprises at least two vertical rods connected at respective opposite ends to and extending between said carriages, the cleaning head being pivotally mounted one of said vertical rods so as to be slidable vertically therealong and rotatable about a vertical axis.

7. Apparatus for manually guided cleaning of a vertical planar surface mounted on a wall, comprising:

top and bottom channel tracks fixedly mounted along the upper and lower edges of the surface;

top and bottom carriages respectively manually slidable horizontally along the top and bottom channel tracks;

means for connecting together the top and bottom carriages, including a plurality of vertical rods connected at their upper and lower extremities to the top and bottom carriages; and a cleaning head pivotally and slidably mounted on one of the vertical rods so as to be slidable vertically therealong and rotatable about a vertical axis, for selective wiping engagement with the surface.

8. A cleaning apparatus according to claim 7, wherein the cleaning head includes a removable wiping element.

9. The combination, with a blackboard having a vertically extending smooth writable surface and mounted on a wall, of apparatus for cleaning said surface, said apparatus comprising:

a frame having a vertical extent substantially equal to said surface;

means for supporting said frame on said wall for manual movement of said frame horizontally back and forth across said surface;

a cleaning head including a holder and a wiping element, removably carried by the holder, for cleaning the surface, said cleaning head having a vertical extent substantially shorter than the vertical dimension of said surface;

means for mounting said holder on said frame for sliding manual vertical movement relative to said surface, and for pivotal manual movement about a vertical axis between a first position in which the wiping element engages the surface and a second position in which the wiping element is out of engagement with the surface, the wiping element being detachable from the holder when the holder is in the second position.

10. The combination according to claim 9, wherein said supporting means comprises upper and lower horizontal tracks respectively secured to the wall adjacent upper and lower horizontal edges of the surface, and wherein said frame comprises upper and lower carriages having rolling elements, the rolling elements of said upper and lower carriages being respectively received in said upper and lower tracks.

11. The combination according to claim 10, wherein said frame further comprises at least one rod, having a vertical axis, secured to and extending between said carriages, and wherein said mounting means comprises means for mounting said holder on said one rod for sliding manual vertical movement therealong and for manual pivotal movement about the vertical axis of said one rod.

* * * * *